US012421799B2

(12) United States Patent
Al-Mousa et al.

(10) Patent No.: US 12,421,799 B2
(45) Date of Patent: Sep. 23, 2025

(54) WHIPSTOCK TO PLUG AND ABANDON WELLBORE BELOW SETTING DEPTH

(71) Applicant: Saudi Arabian Oil Company, Dhahran (SA)

(72) Inventors: Ahmed Abdulaziz Al-Mousa, Dhahran (SA); Hassan K. Al-Aswad, Qatif (SA); Omar M. Al Hamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/667,229

(22) Filed: May 17, 2024

(65) Prior Publication Data

US 2024/0301754 A1 Sep. 12, 2024

Related U.S. Application Data

(62) Division of application No. 17/751,987, filed on May 24, 2022, now Pat. No. 12,018,565.

(51) Int. Cl.

| | |
|---|---|
| ***E21B 7/06*** | (2006.01) |
| ***E21B 23/06*** | (2006.01) |
| ***E21B 33/14*** | (2006.01) |

(52) U.S. Cl.

CPC ..... *E21B 7/061* (2013.01); *E21B 23/06* (2013.01); *E21B 33/14* (2013.01)

(58) Field of Classification Search

CPC ..... E21B 29/06

See application file for complete search history.

(56) References Cited

U.S. PATENT DOCUMENTS

| | | | |
|---|---|---|---|
| 1,896,482 | A | 2/1933 | Crowell |
| 2,121,002 | A | 6/1938 | Baker |
| 2,187,487 | A | 1/1940 | Burt |
| 2,189,697 | A | 2/1940 | Baker |
| 2,222,233 | A | 11/1940 | Mize |
| 2,327,092 | A | 8/1943 | Botkin |
| 2,672,199 | A | 3/1954 | McKenna |
| 2,806,532 | A | 9/1957 | Baker et al. |

(Continued)

FOREIGN PATENT DOCUMENTS

| | | |
|---|---|---|
| AU | 2017225085 | 9/2017 |
| WO | WO 2017043977 | 3/2017 |
| WO | WO 2018017104 | 1/2018 |

OTHER PUBLICATIONS

Bruton et al., "Whipstock Options for Sidetracking," Oilfield Review, Jan. 2014, 26(1):16-25, 10 pages.

*Primary Examiner* — William D Hutton, Jr.
*Assistant Examiner* — Avi T Skaist
(74) *Attorney, Agent, or Firm* — Fish & Richardson P.C.

(57) ABSTRACT

A wellbore assembly to plug and abandon a wellbore below a setting depth includes a whipstock assembly configured to drill a lateral wellbore from a primary wellbore formed in a subterranean zone. The wellbore assembly includes a tool assembly connected to the whipstock assembly. The tool assembly is configured to be lowered into the primary wellbore during the same trip as the whipstock assembly. The tool assembly is configured to perform wellbore operations downhole of a casing window from which the whipstock assembly is configured to drill the lateral wellbore before the whipstock assembly drills the lateral wellbore.

6 Claims, 5 Drawing Sheets

(56) References Cited

U.S. PATENT DOCUMENTS

| | | | | |
|---|---|---|---|---|
| 3,116,799 | A | 1/1964 | Lemons | |
| 4,349,071 | A | 9/1982 | Fish | |
| 4,391,326 | A | 7/1983 | Greenlee | |
| 4,538,684 | A | 9/1985 | Sheffield | |
| 4,624,312 | A | 11/1986 | McMullin | |
| 4,735,268 | A | 4/1988 | Harris et al. | |
| 4,834,184 | A | 5/1989 | Streich et al. | |
| 4,928,762 | A | 5/1990 | Mamke | |
| 4,953,617 | A | 9/1990 | Ross et al. | |
| 5,178,219 | A | 1/1993 | Striech et al. | |
| 5,330,000 | A | 7/1994 | Givens et al. | |
| 5,715,891 | A * | 2/1998 | Graham | E21B 41/0035 166/117.6 |
| 5,806,596 | A | 9/1998 | Hardy et al. | |
| 6,491,108 | B1 | 12/2002 | Slup et al. | |
| 6,595,289 | B2 | 7/2003 | Tumlin et al. | |
| 7,424,909 | B2 | 9/2008 | Roberts et al. | |
| 7,600,572 | B2 | 10/2009 | Slup et al. | |
| 7,762,323 | B2 | 7/2010 | Frazier | |
| 8,579,024 | B2 | 11/2013 | Mailand et al. | |
| 8,770,276 | B1 | 7/2014 | Nish et al. | |
| 9,359,861 | B2 | 6/2016 | Burgos | |
| 9,416,617 | B2 | 8/2016 | Wiese et al. | |
| 9,863,214 | B2 | 1/2018 | Cronley | |
| 10,280,706 | B1 | 5/2019 | Sharp, III | |
| 10,837,254 | B2 | 11/2020 | Al-Mousa et al. | |
| 2004/0040707 | A1 | 3/2004 | Dusterhoft et al. | |
| 2005/0263282 | A1 | 12/2005 | Jeffrey et al. | |
| 2006/0213656 | A1 | 9/2006 | Clifton | |
| 2008/0185148 | A1 | 8/2008 | Carter et al. | |
| 2008/0314591 | A1 | 12/2008 | Hales et al. | |
| 2011/0203794 | A1 | 8/2011 | Moffitt et al. | |
| 2013/0213654 | A1 | 8/2013 | Dewey et al. | |
| 2013/0240207 | A1 | 9/2013 | Frazier | |
| 2016/0084034 | A1 | 3/2016 | Roane et al. | |
| 2016/0281458 | A1 | 9/2016 | Greenlee | |
| 2017/0067313 | A1 | 3/2017 | Connell et al. | |
| 2018/0010418 | A1 | 1/2018 | VanLue | |
| 2018/0252069 | A1 | 9/2018 | Abdollah et al. | |
| 2019/0284898 | A1 | 9/2019 | Fagna et al. | |
| 2020/0056446 | A1 | 2/2020 | Al-Mousa et al. | |
| 2021/0025259 | A1 | 1/2021 | Al-Mousa et al. | |
| 2021/0054708 | A1 * | 2/2021 | Al-Mousa | E21B 33/134 |

* cited by examiner

WHIPSTOCK TO PLUG AND ABANDON WELLBORE BELOW SETTING DEPTH

CROSS-REFERENCE TO RELATED PATENT APPLICATIONS

This application is a divisional of and claims the benefit of priority to U.S. patent application Ser. No. 17/751,987, filed May 24, 2022, the contents of which are incorporated by reference herein.

TECHNICAL FIELD

This disclosure relates to forming wellbores in subterranean zones, and specifically to forming lateral wellbores using whipstock assemblies.

BACKGROUND

Hydrocarbons trapped in subsurface reservoirs can be raised to the surface of the Earth (that is, produced) through wellbores formed from the surface to the subsurface reservoirs. Wellbore drilling systems are used to drill wellbores through a subterranean zone (for example, a formation, a portion of a formation or multiple formations) to the subsurface reservoir. At a high level, the wellbore drilling system includes a drill bit connected to an end of a drill string. The drill string is rotated and weight is applied on the drill bit to drill through the subterranean zone. Wellbore drilling fluid (also known as drilling mud) is flowed in a downhole direction through the drill string. The drilling fluid exits the drill bit through ports defined in the drill bit and flows in an uphole direction through an annulus defined by an outer surface of the drill string and an inner wall of the wellbore. As the drilling fluid flows towards the surface, it carries any cuttings and debris released into the wellbore due to and during the drilling. The cuttings and debris are released from the subterranean zone as the drill bit breaks the rock while penetrating the subterranean zone. When mixed with the drilling fluid, the cuttings and debris form a solid slurry that flows to the surface. At the surface, the cuttings and debris are filtered and the wellbore drilling fluid can be recirculated into the wellbore to continue drilling. The cuttings and debris carried to the surface by the drilling fluid provide useful information, among other things, about the wellbore being formed and the drilling process.

In some wellbore operations, a primary wellbore is formed in the subterranean zone. A lateral wellbore, which is an angled wellbore, is formed at a setting depth through a side wall of the primary wellbore to increase contact with the subsurface reservoir. Whipstock assemblies are used to form lateral wellbores.

SUMMARY

This disclosure describes whipstock assemblies to plug and abandon a wellbore, e.g., a primary wellbore, below a setting depth.

Certain aspects of the subject matter described here can be implemented as a wellbore tool assembly. The assembly includes a whipstock assembly configured to drill a lateral wellbore from a primary wellbore formed in a subterranean zone. The wellbore tool assembly includes a tool assembly connected to the whipstock assembly. The tool assembly is configured to be lowered into the primary wellbore during the same trip as the whipstock assembly. The tool assembly is configured to perform wellbore operations downhole of a casing window from which the whipstock assembly is configured to drill the lateral wellbore before the whipstock assembly drills the lateral wellbore.

An aspect combinable with any other aspect includes the following features. The whipstock assembly includes a milling assembly and a whipstock tool face connected to the milling assembly. The tool assembly is connected to the whipstock tool face. The tool assembly is mounted to a downhole end of the whipstock tool face. The tool assembly includes a first packer.

An aspect combinable with any other aspect includes the following features. The tool assembly includes a second packer. The first packer is between the second packer and the downhole end of the whipstock tool face.

An aspect combinable with any other aspect includes the following features. The first packer is configured to be set before the second packer.

An aspect combinable with any other aspect includes the following features. The tool assembly includes a cement sub. The first packer is between the cement sub and the downhole end of the whipstock tool face.

An aspect combinable with any other aspect includes the following features. The cement sub is configured to flow cement from a surface of the primary wellbore through and downhole of each of the whipstock tool assembly and the tool assembly.

Certain aspects of the subject matter described here can be implemented as a method. A wellbore tool assembly is lowered into a primary wellbore formed in a subterranean zone. The wellbore tool assembly is lowered to a depth from which a lateral wellbore is to be formed from the primary wellbore. The wellbore tool assembly includes a whipstock assembly configured to drill a lateral wellbore from a primary wellbore formed in a subterranean zone. The wellbore tool assembly includes a tool assembly connected to the whipstock assembly. Before forming the lateral wellbore, a well operation is performed, using the tool assembly, downhole of a casing window from which the lateral wellbore is to be formed. After performing the well operation, the lateral wellbore is formed using the whipstock assembly.

An aspect combinable with any other aspect includes the following features. The whipstock assembly includes a milling assembly and a whipstock tool face connected to the milling assembly. The tool assembly is connected to the whipstock tool face. The tool assembly is mounted to a downhole end of the whipstock tool face. The tool assembly includes a first packer. The tool assembly is lowered into the primary wellbore first, followed by the whipstock tool assembly.

An aspect combinable with any other aspect includes the following features. The whipstock assembly and the tool assembly are lowered in the same trip into the primary wellbore.

An aspect combinable with any other aspect includes the following features. The tool assembly includes a second packer. The first packer is between the second packer and the downhole end of the whipstock tool face. To perform the well operation, the first packer is set before second packer is set.

An aspect combinable with any other aspect includes the following features. The well operation includes flowing cement from a surface of the primary wellbore through and downhole of each of the whipstock tool assembly and the tool assembly.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

When completing and working over wellbores, several wellbore operations require running whipstock assemblies into the wellbore to perform site tracks. Prior to performing sidetracks, the existing wellbore needs to be plugged and abandoned. One technique to plug and abandon the existing wellbore is to run and set a cement retainer, which is an isolation tool set, in the casing or liner to enable treatments to be applied to a lower interval while providing isolation from the annulus above. Cement retainers are typically used in cement squeeze or similar remedial treatments. Additionally, fluids cannot be pumped down through the whipstock assembly to lubricate the wellbore or clean out the debris around the setting depth of the whipstock assembly. This disclosure describes a cement retainer sub and a modified whipstock assembly design to allow the whipstock assembly to pump and squeeze cement that will plug and abandon the whole below the setting depth while pumping through the whipstock assembly down to the circulation ports.

Figure 1:
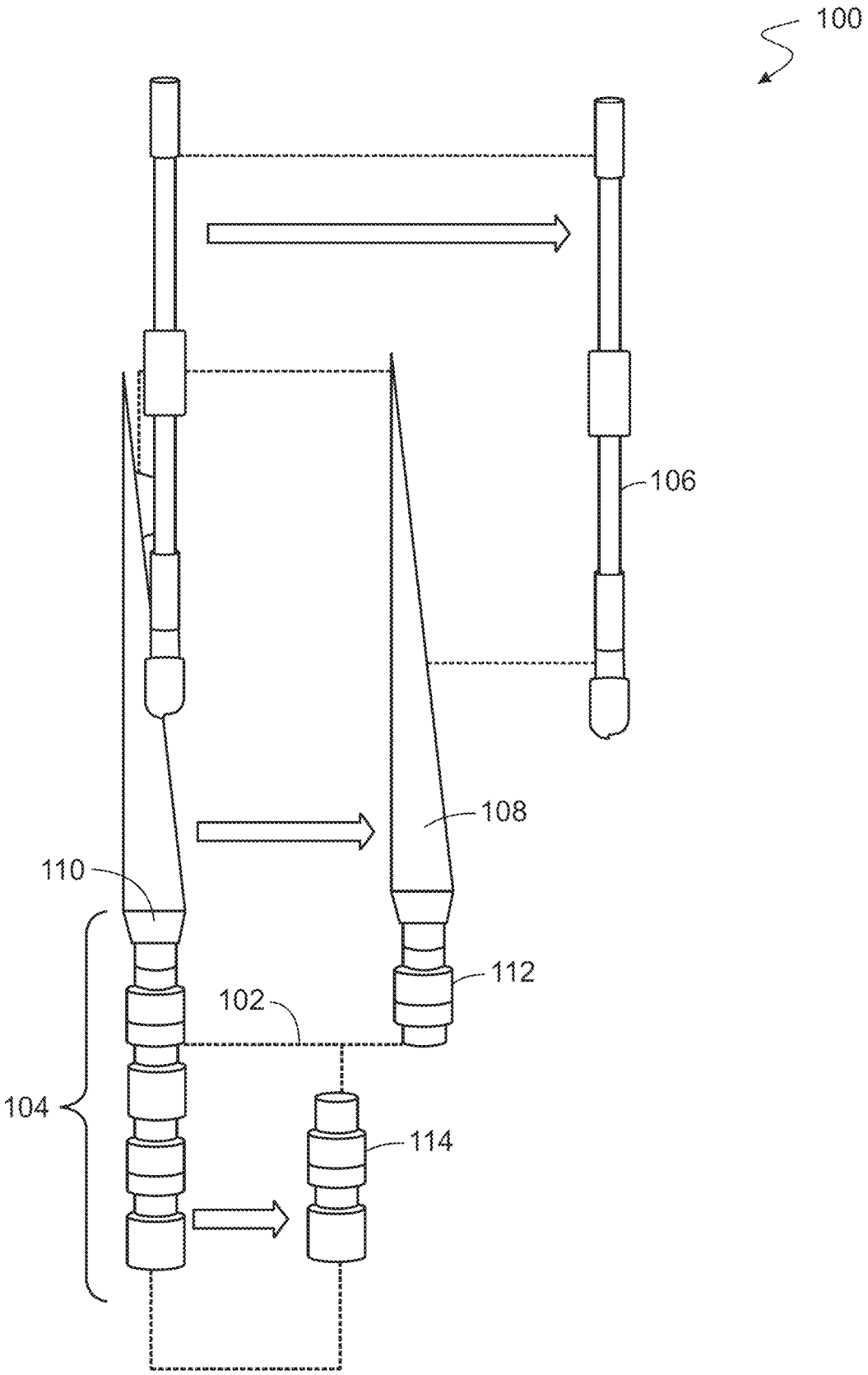
FIG. 1 is schematic diagram of a wellbore tool assembly.

FIG. 1 is schematic diagram of a wellbore tool assembly 100. The wellbore tool assembly 100 includes a whipstock assembly 102 that is configured to drill a lateral wellbore (shown later) from a primary wellbore (shown later) in a subterranean zone. The whipstock assembly 102 is connected to a tool assembly 104, which includes multiple components described below. The tool assembly 104 is configured to be lowered into the primary wellbore during the same trip as the whipstock assembly 102. The tool assembly 104 is configured to perform wellbore operations downhole of a casing window (shown later) from which the whipstock assembly 102 is configured to drill the lateral wellbore before the whipstock assembly drills the lateral wellbore.

In some implementations, the whipstock assembly 102 includes a milling assembly 106 and a whipstock tool face 108 connected to the milling assembly 102. The tool assembly 104 is connected to the whipstock tool face 108. For example, the tool assembly 104 is mounted to a downhole end 110 of the whipstock tool face 108. The downhole end 110 of the whipstock tool face 108 is the end of the whipstock assembly 102 that is lowered first into the primary wellbore.

In some implementations, the tool assembly 104 includes a first packer 112 that is configured to isolate the primary wellbore downhole of the first packer 112 relative to the primary wellbore uphole of the first packer 112. In such implementations, the tool assembly 104 includes a second packer 114. The first packer 112 is positioned between the second packer 114 and the downhole end 110 of the whipstock tool face 108. The second packer 114 is also configured to isolate the primary wellbore downhole of the second packer 114 relative to the primary wellbore up whole of the second packer 114. In operation, the first packer 112 is set before setting the second packer 114.

Figures 2A, 2B, 2C, 2D:
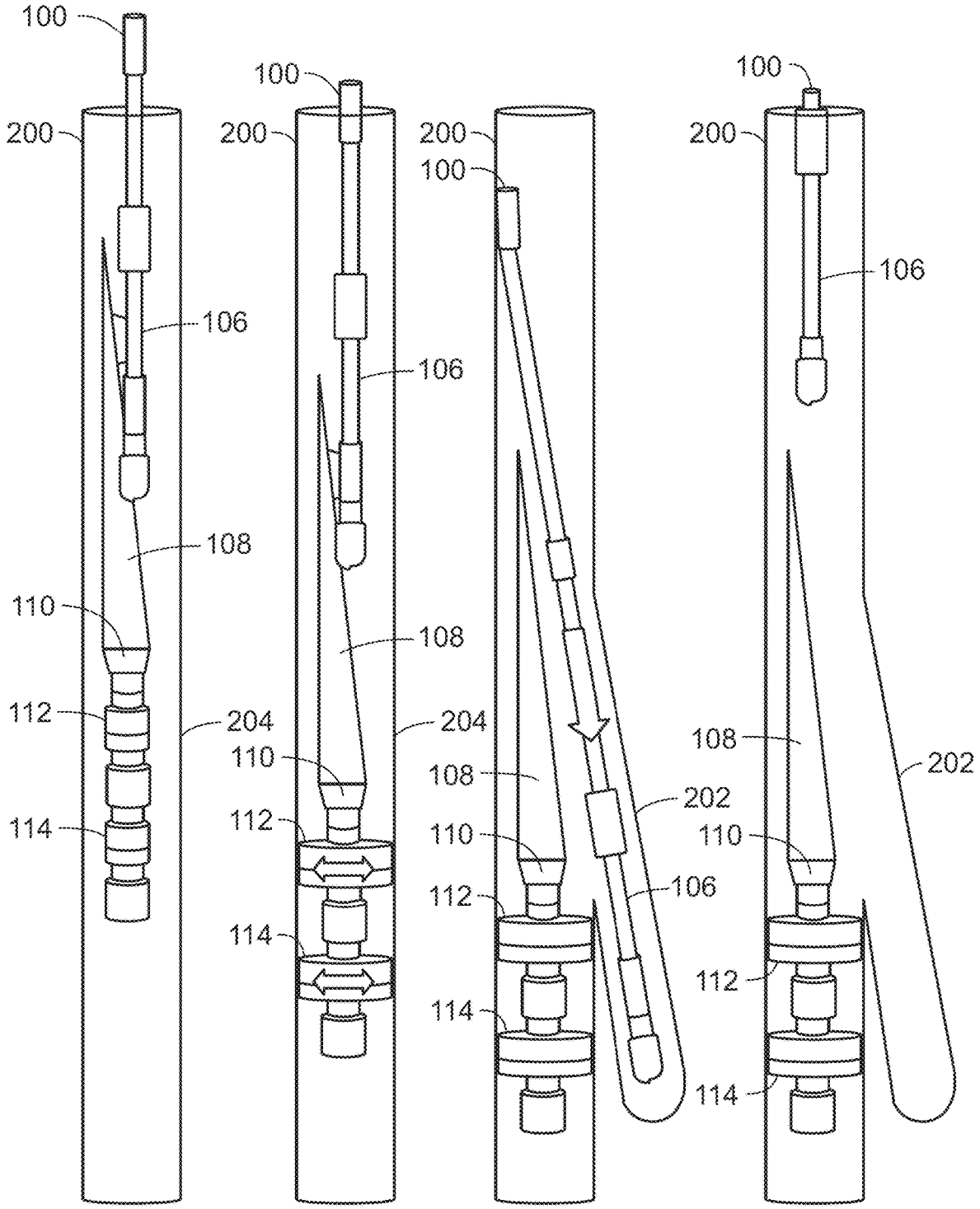
FIGS. 2A-2D are schematic diagrams showing use of the wellbore tool assembly of FIG. 1.

FIGS. 2A-2D are schematic diagrams showing use of the wellbore tool assembly 100 of FIG. 1. FIG. 2A shows the wellbore tool assembly 100 assembled and lowered into the primary wellbore 200, specifically into a casing installed in the primary wellbore 200. For example, the wellbore tool assembly 100 can be lowered into the casing in a single trip using a wireline, a slick line, or coiled tubing. FIG. 2B shows the first packer 112 and the second packer 114 mounted to the tool assembly 104 being set. As described above, the first packer 112 is set before the second packer 114. Setting each packer isolates portions of primary wellbore 200 downhole of each packer relative to portions of the primary wellbore 200 up whole of each packer. FIG. 2C shows the milling assembly 106 off the whipstock assembly 102 being deployed to drill the lateral wellbore 202 through the casing window 204. For example, the shear bolts (not shown) off the whipstock assembly 102 allow the milling assembly 106 to detach from the whipstock assembly 102 and to initiate the sidetracking to form the lateral wellbore 202. FIG. 2D shows the milling assembly 106 being withdrawn from the lateral wellbore 202 leaving the whipstock tool face 108 within the primary wellbore 200.

Figure 3:
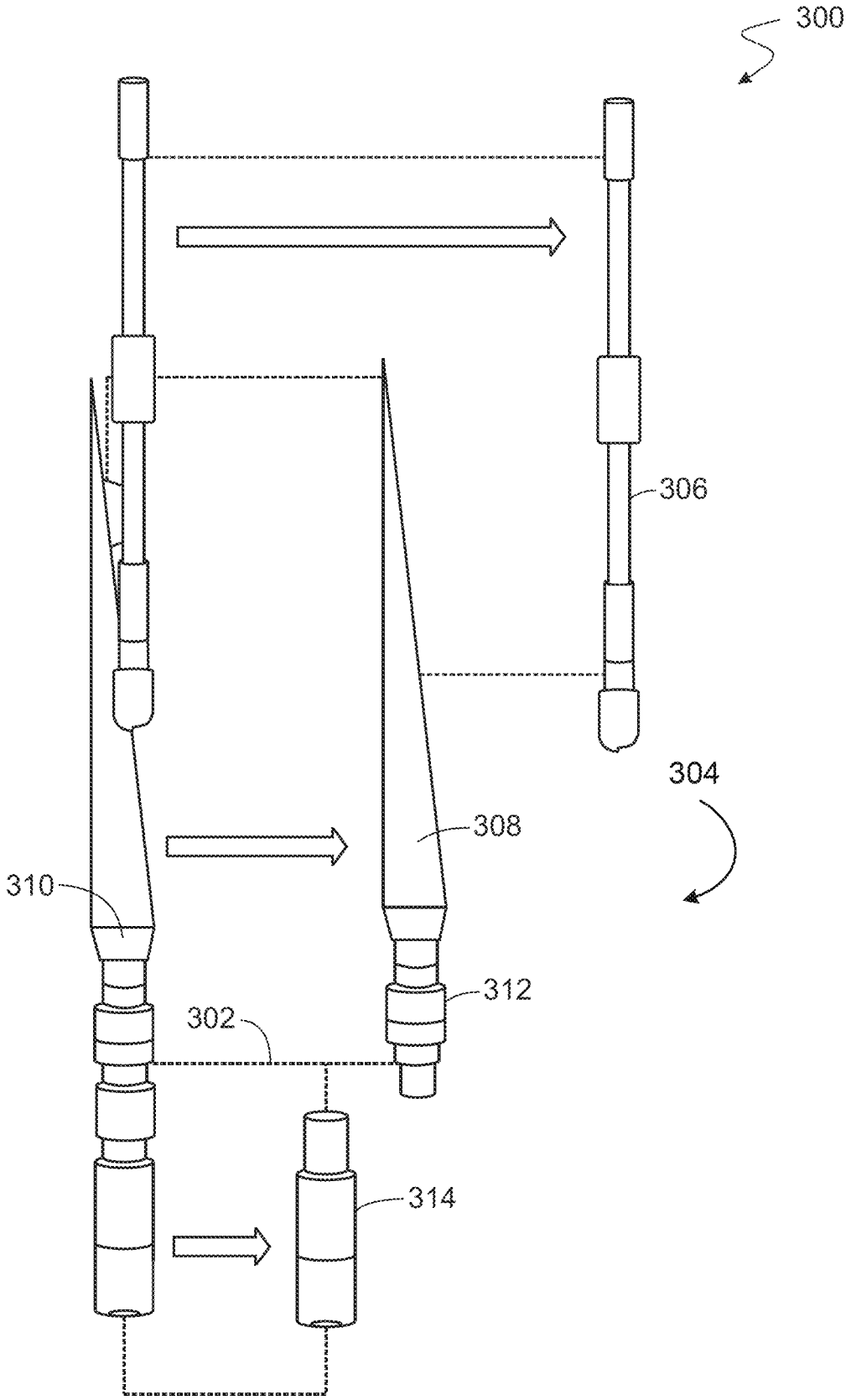
FIG. 3 is a schematic diagram of a wellbore tool assembly.

FIG. 3 is a schematic diagram of a wellbore tool assembly 300. The wellbore tool assembly 300 includes a whipstock assembly 302 that is configured to drill a lateral wellbore (shown later) from a primary wellbore (shown later) in a subterranean zone. The whipstock assembly 302 is connected to a tool assembly 304, which includes multiple components described below. The tool assembly 304 is configured to be lowered into the primary wellbore during the same trip as the whipstock assembly 302. The tool assembly 304 is configured to perform wellbore operations downhole of a casing window (shown later) from which the whipstock assembly 302 is configured to drill the lateral wellbore before the whipstock assembly drills the lateral wellbore.

In some implementations, the whipstock assembly 302 includes a milling assembly 306 and a whipstock tool face 308 connected to the milling assembly 302. The tool assembly 304 is connected to the whipstock tool face 308. For example, the tool assembly 304 is mounted to a downhole end 310 of the whipstock tool face 308. The downhole end 310 of the whipstock tool face 308 is the end of the whipstock assembly 302 that is lowered first into the primary wellbore.

In some implementations, the tool assembly 304 includes a first packer 312 that is configured to isolate the primary wellbore downhole of the first packer 312 relative to the primary wellbore uphole of the first packer 312. In such implementations, the tool assembly 304 includes cement circulation sub 314. The first packer 312 is positioned between the cement circulation sub 314 and the downhole end 310 of the whipstock tool face 308. The cement circulation sub 314 is configured to circulate cement throughout the wellbore tool assembly 300. In particular, the cement circulation sub 314 is configured to flow cement from a surface of the primary wellbore through and downhole of each of the whipstock tool assembly 302 and the tool assembly 304. The cement that is flowed downhole of the wellbore tool assembly 300, once hardened, can isolate portions of the primary wellbore downhole of the cement circulation sub 314 relative to portions of the primary wellbore up whole of the cement circulation sub 314.

Figures 4A, 4B, 4C, 4D:
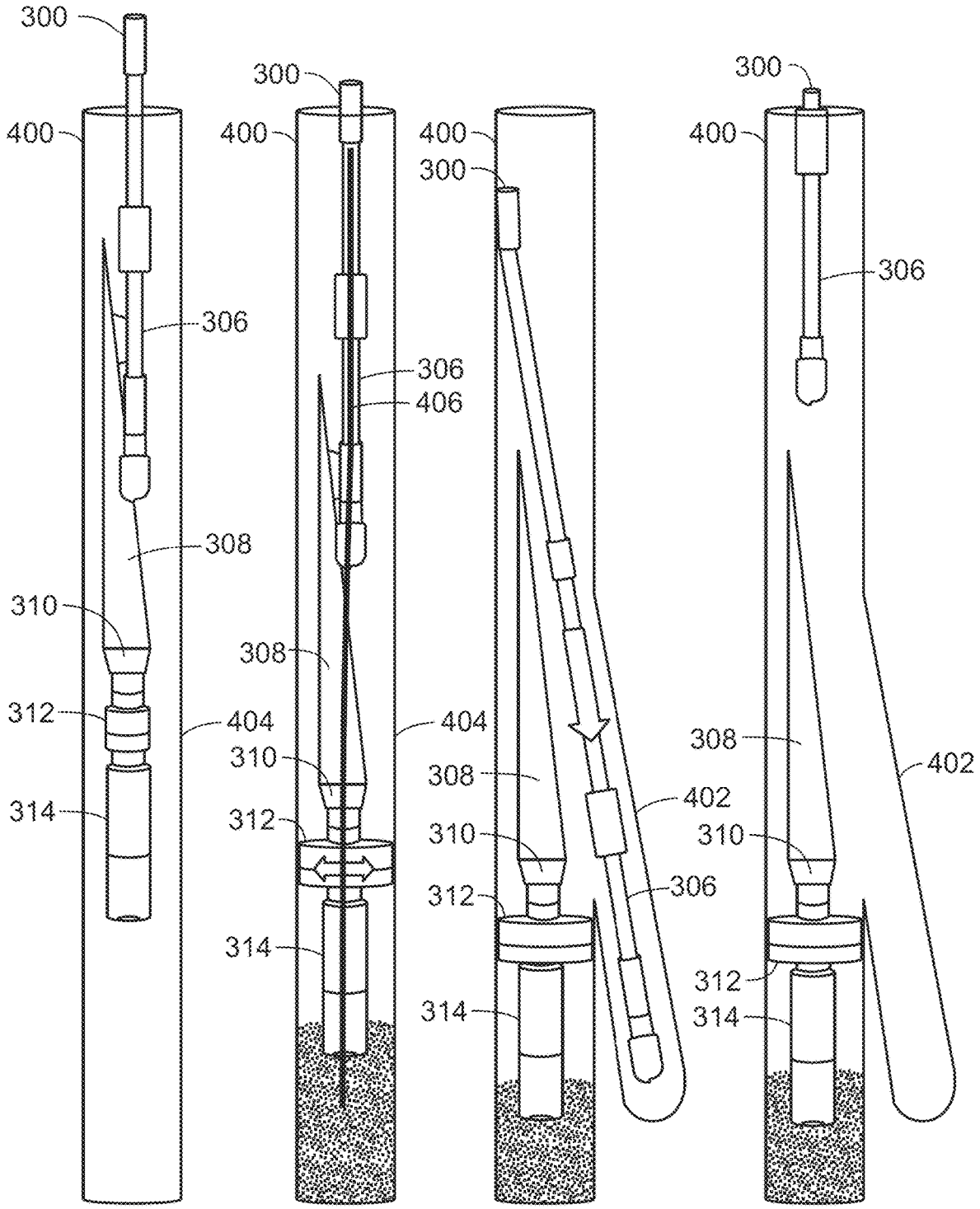
FIGS. 4A-4D are schematic diagrams showing use of the wellbore tool assembly of FIG. 3.

FIGS. 4A-4D are schematic diagrams showing use of the wellbore tool assembly of FIG. 3. FIG. 4A shows the wellbore tool assembly 300 assembled and lowered into the primary wellbore 400, specifically into a casing installed in the primary wellbore 400. For example, the wellbore tool assembly 300 can be lowered into the casing in a single trip using a wireline, a slick line, or coiled tubing. FIG. 4B shows the first packer 312 and the cement circulation sub 314 mounted to the tool assembly 304 being set. As described above, the first packer 312 is set to isolate the portion of the wellbore 400. Then, cement is pumped and squeezed through the wellbore tool assembly 300, as represented by the cement flow pathway 406 through. Other fluids can also be flowed through the flow pathway 406. Once the cement hardens, the portion of the primary wellbore 400 below the cement circulating sub 314 is isolated from the portion of the primary wellbore 400 above the cement circulating sub 314. FIG. 4C shows the milling assembly 306 off the whipstock assembly 302 being deployed to drill the lateral wellbore 402 through the casing window 404. For example, the shear bolts (not shown) off the whipstock assembly 202 allow the milling assembly 106 to detach from the whipstock assembly 302 and to initiate the sidetracking to form the lateral wellbore 402. FIG. 4D shows the milling assembly 306 being withdrawn from the lateral wellbore 402 leaving the whipstock tool face 308 within the primary wellbore 400.

Figure 5:
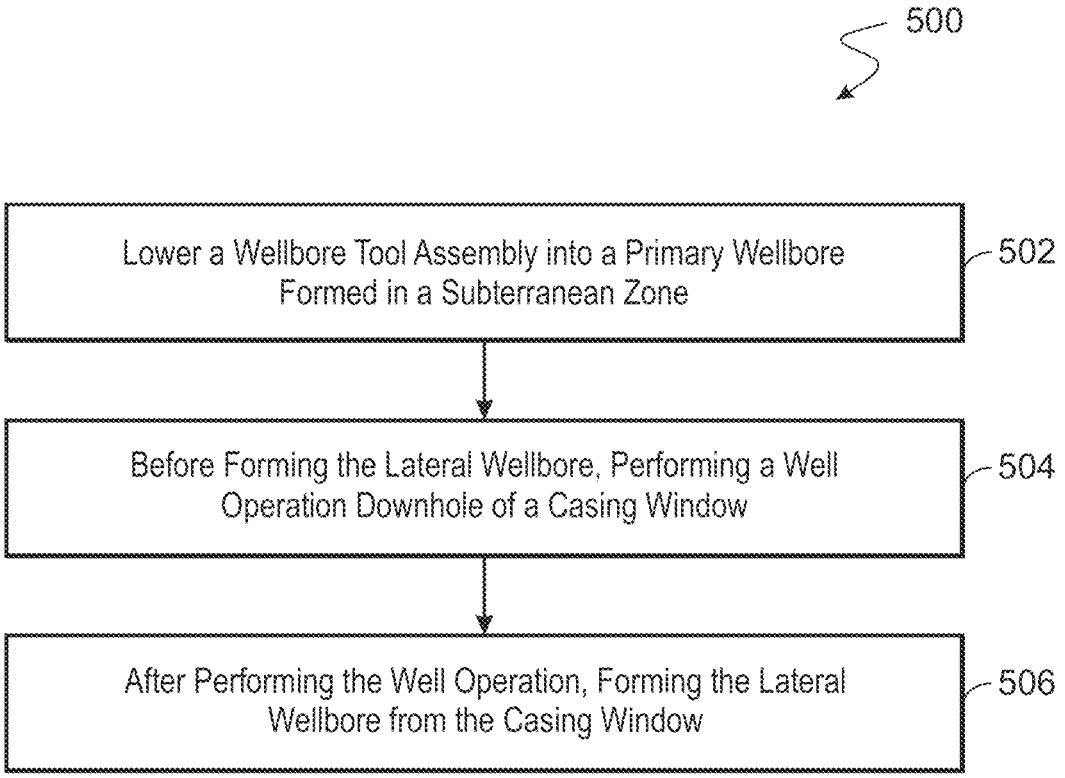
FIG. 5 is a flowchart of an example of a process of using the wellbore tool assembly of FIG. 1 or FIG. 3.

FIG. 5 is a flowchart of an example of a process 500 of using the wellbore tool assembly of FIG. 1 or FIG. 3. In some implementations, the process 500 can be performed by a wellbore operator, specifically an operator of a wellbore drilling assembly. At 502, the operator lowers a wellbore tool assembly (e.g., the wellbore tool assembly 100 or the wellbore tool assembly 300) into a primary wellbore formed in a subterranean zone. The wellbore tool assembly is lowered to a depth from which a lateral wellbore is to be formed from the primary wellbore. At 504, before forming the lateral wellbore, the operator performs a well operation using the wellbore tool assembly. For example, the operator performs the well operation downhole of a casing window from which the lateral wellbore is to be formed. In implementations in which the wellbore tool assembly includes the tool assembly 104 (FIGS. 1, 2A-2D), the well operation includes setting the first and second packers to isolate the portion of the wellbore downhole of the tool assembly from the portion of the wellbore uphole of the tool assembly. In implementations in which the wellbore tool assembly includes the tool assembly 304 (FIGS. 3, 4A-4D), the well operation includes setting the first packer and circulating cement using the cement circulation sub 314 to isolate the portion of the wellbore downhole of the tool assembly from the portion of the wellbore uphole of the tool assembly. At 506, after performing the well operation, the operator can use the whipstock assembly to form the lateral wellbore from the casing window.

Thus, particular implementations of the subject matter have been described. Other implementations are within the scope of the following claims.

The invention claimed is:

1. A method comprising:

lowering a wellbore tool assembly into a primary wellbore formed in a subterranean zone, wherein the wellbore tool assembly is lowered to a depth from which a lateral wellbore is to be formed from the primary wellbore, wherein the wellbore tool assembly comprises:

a whipstock assembly configured to drill the lateral wellbore, wherein the whipstock assembly comprises a milling assembly and a whipstock tool face connected to the milling assembly, wherein the whipstock tool face is at a downhole end of the whipstock assembly; and a tool assembly connected to the whipstock assembly, wherein the tool assembly comprises:

a cement sub mounted to a downhole end of the tool assembly such that the cement sub is at the downhole end of the tool assembly, and a first packer which when set is configured to isolate the primary wellbore downhole of the first packer, wherein the first packer is between the cement sub at the downhole end of the tool assembly and the downhole end of the whipstock tool face, wherein the tool assembly is mounted to a downhole end of the whipstock tool face such that the tool assembly is downhole of the whipstock assembly when the wellbore tool assembly is lowered into the primary wellbore;

before forming the lateral wellbore, performing, using the tool assembly, a well operation downhole of a casing window from which the lateral wellbore is to be formed; and after performing the well operation, forming, using the whipstock assembly, the lateral wellbore.

2. The method of claim 1, wherein the whipstock assembly comprises a milling assembly and a whipstock tool face connected to the milling assembly, wherein the tool assembly is connected to the whipstock tool face, wherein the tool assembly is mounted to a downhole end of the whipstock tool face, wherein the tool assembly comprises a first packer, wherein lowering the wellbore tool assembly into the primary wellbore comprises lowering the tool assembly first followed by the whipstock assembly.

3. The method of claim 2, wherein lowering the wellbore tool assembly into the primary wellbore comprises lowering the whipstock assembly and the tool assembly in the same trip into the primary wellbore.

4. The method of claim 2, wherein the tool assembly comprises a second packer, wherein the first packer is between the second packer and the downhole end of the whipstock tool face, wherein performing the well operation comprises setting the first packer before setting the second packer.

5. The method of claim 2, wherein the tool assembly comprises a cement sub, wherein the first packer is between the cement sub and the downhole end of the whipstock tool face.

6. The method of claim 5, wherein the well operation comprises flowing cement from a surface of the primary wellbore through and downhole of each of the whipstock tool assembly and the tool assembly.

* * * * *